US011746519B2

(12) United States Patent
Møller

(10) Patent No.: US 11,746,519 B2
(45) Date of Patent: Sep. 5, 2023

(54) BUILDING CONSTRUCTION SYSTEM

(71) Applicant: MOELLER s.r.o., Zilina (SK)

(72) Inventor: Jens Møller, Zilina (SK)

(73) Assignee: MOELLER s.r.o., Zilina (SK)

( * ) Notice: Subject to any disclaimer, the term of this patent is extended or adjusted under 35 U.S.C. 154(b) by 208 days.

(21) Appl. No.: 16/739,751

(22) Filed: Jan. 10, 2020

(65) Prior Publication Data

US 2020/0149265 A1 May 14, 2020

Related U.S. Application Data

(63) Continuation of application No. PCT/EP2018/068051, filed on Jul. 4, 2018.

(30) Foreign Application Priority Data

Jul. 10, 2017 (DK) ..... PA 2017 00407

(51) Int. Cl.
*E04B 1/14* (2006.01)
*E04B 1/41* (2006.01)
(Continued)

(52) U.S. Cl.
CPC ..... *E04B 1/14* (2013.01); *E04B 1/40* (2013.01); *E04C 2/2885* (2013.01); *E04D 13/064* (2013.01)

(58) Field of Classification Search
CPC ..... E04B 1/14; E04B 1/40; E04B 1/41; E04B 1/4178; E04B 1/6145; E04B 2001/6195;
(Continued)

(56) References Cited

U.S. PATENT DOCUMENTS 2,647,287 A * 8/1953 Jones ..... E04B 1/6183 52/582.2
2,875,478 A * 3/1959 Andre ..... E04B 2/08 52/586.1
(Continued)

FOREIGN PATENT DOCUMENTS

CA 2156769 A * 10/1999 ..... E04C 2/292
CN 1761550 A 4/2006
(Continued)

OTHER PUBLICATIONS

International Patent Application No. PCT/EP2018/068051, International Search Report (ISR) and Written Opinion dated Sep. 28, 2018—11 pages.
(Continued)

*Primary Examiner* — Jessica L Laux
(74) *Attorney, Agent, or Firm* — Cozen O'Connor

(57) ABSTRACT

A building construction system (2) for construction of a building (20) is disclosed. The building construction system (2) comprises a plurality of modules ($M_1$, $M_2$, $M_3$, $M_4$, $M_5$, $M_6$, $M_7$, $M_8$, $M_9$, $M_{10}$, $M_{11}$), each comprising at least one centrally arranged insulation member (4, 4') sandwiched between a first cover plate (12, 12') and a second cover plate (14, 14'). The at least one insulation member (4, 4') is made in polyurethane (PUR) or polyisocyanurate (PIR). A reinforcement connection structure (10) extends between and is mechanically connected to opposite cover plates (12, 12', 14, 14'). At least a portion of the joints (6, 6') between adjacent cover plates (12, 12', 14, 14') are glued together.

11 Claims, 8 Drawing Sheets

(51) Int. Cl.
*E04C 2/288* (2006.01)
*E04D 13/064* (2006.01)

(58) Field of Classification Search
CPC ..... E04B 2/02; E04B 2/26; E04B 2/28; E04B 2/44; E04C 2/2885; E04C 2/284; E04C 2/288; E04C 2/292; E04C 2/296; E04C 2/38; E04C 2/384; E04C 2/46; E04C 2002/045; E04D 13/064
See application file for complete search history.

(56) References Cited

U.S. PATENT DOCUMENTS 3,313,073 A * 4/1967 Mathews ..... E04B 1/76 52/309.2
3,783,082 A * 1/1974 Almog ..... E04C 2/205 428/48
4,411,118 A * 10/1983 Claver ..... E04B 1/6141 52/582.2
4,443,988 A * 4/1984 Coutu, Sr. ..... E04B 1/80 52/309.2
4,712,352 A * 12/1987 Low ..... E04C 2/521 52/220.2
5,497,589 A * 3/1996 Porter ..... E04C 2/296 52/309.2
5,950,389 A * 9/1999 Porter ..... E04B 1/6145 52/586.1
6,119,427 A * 9/2000 Wyman ..... E04B 1/12 52/127.11
6,279,287 B1 * 8/2001 Meadows ..... E04C 2/292 52/309.9
6,481,172 B1 * 11/2002 Porter ..... B32B 5/18 52/506.01
8,272,182 B1 * 9/2012 Spiegel ..... E04B 1/24 52/407.1
8,756,889 B2 * 6/2014 LeBlang ..... E04B 2/763 52/309.12
8,844,243 B1 * 9/2014 Gillman ..... E04C 2/288 52/745.2
9,057,199 B2 * 6/2015 Gillman ..... E04F 13/0878
9,890,531 B2 * 2/2018 Liberman ..... E04B 2/48
2005/0204697 A1 * 9/2005 Rue ..... E04B 1/14 52/782.1
2014/0069040 A1 * 3/2014 Gibson ..... E04B 1/14 52/506.01
2015/0135634 A1 5/2015 Hoie et al.
2016/0208489 A1 * 7/2016 Gibson ..... E04B 7/22
2021/0131096 A1 * 5/2021 Mordechai ..... E04B 1/6158

FOREIGN PATENT DOCUMENTS

CN 201843253 U 5/2011
DE 20 2015 005886 U1 10/2015
EP 0 794 294 A1 9/1997
EP 2 348 161 A2 7/2011
EP 2 348 161 A3 1/2013
GB 2 399 539 A 9/2004
NL 1028311 C2 6/2006
WO WO 2016/071747 A2 5/2016
WO WO 2016/071747 A3 8/2016

OTHER PUBLICATIONS

Danish Patent Application No. PA 2017 00407, Search Report completed Dec. 13, 2017—4 pages.

* cited by examiner

Fig. 1A
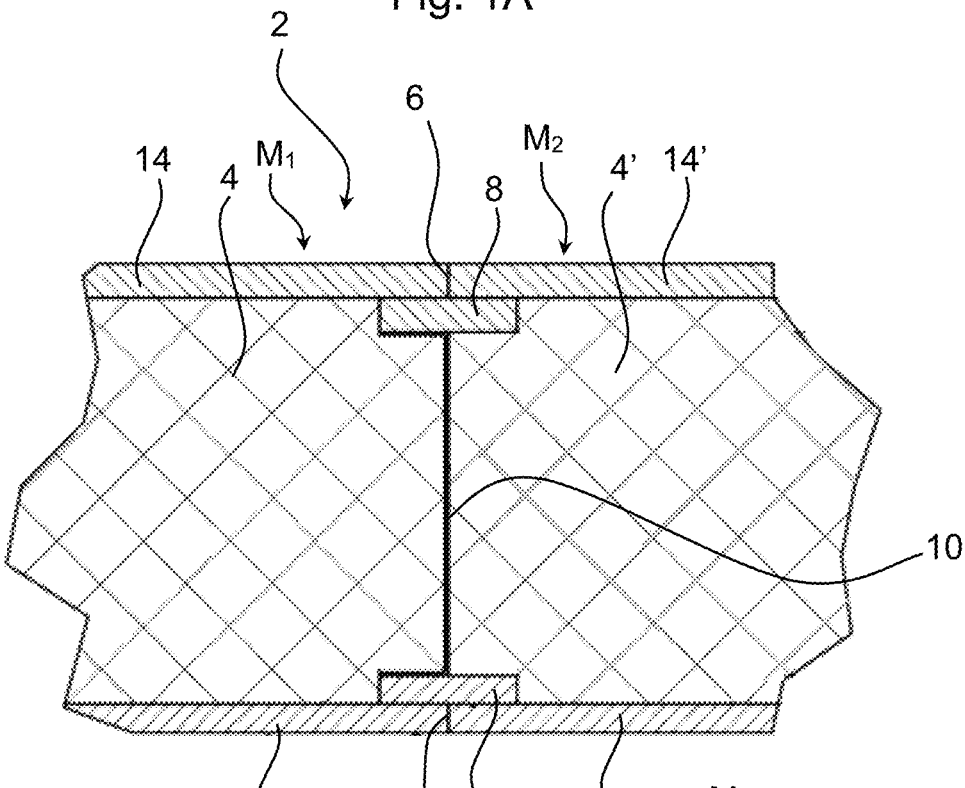
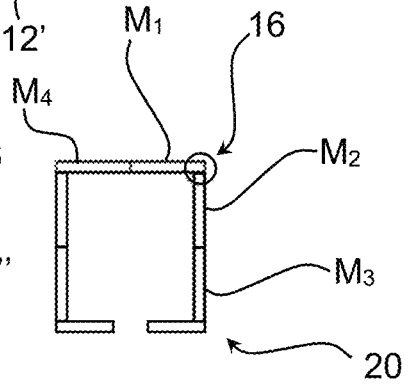
Fig. 1B
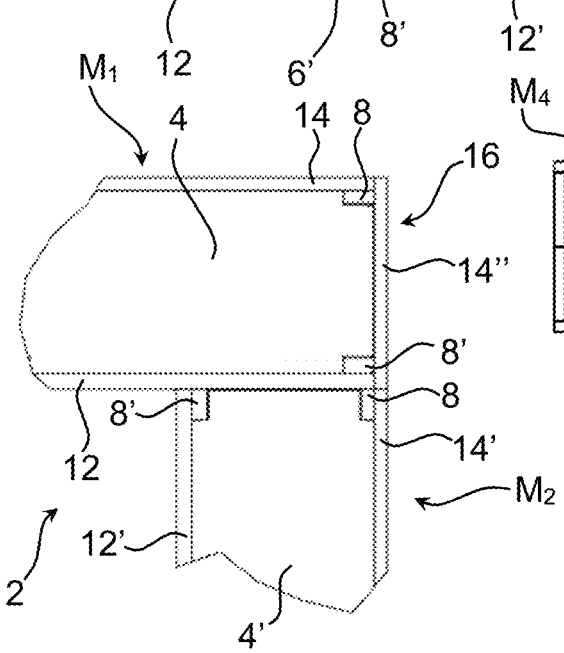
Fig. 1C

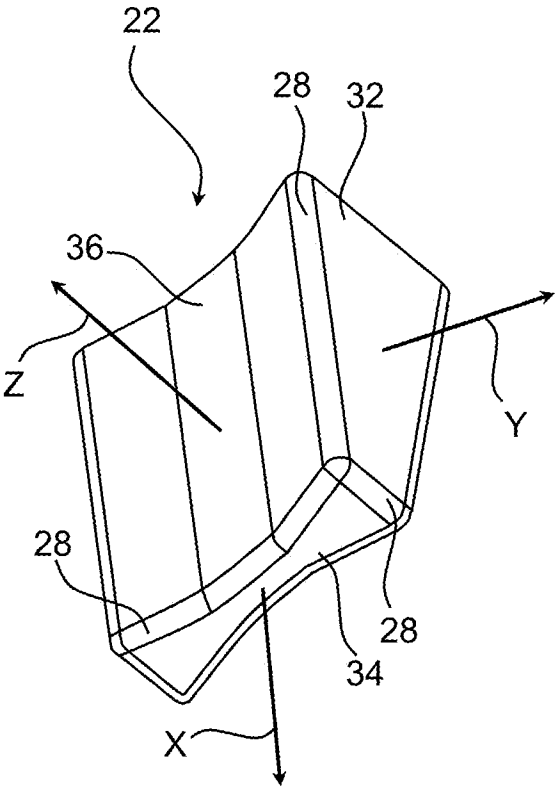
Fig. 2C
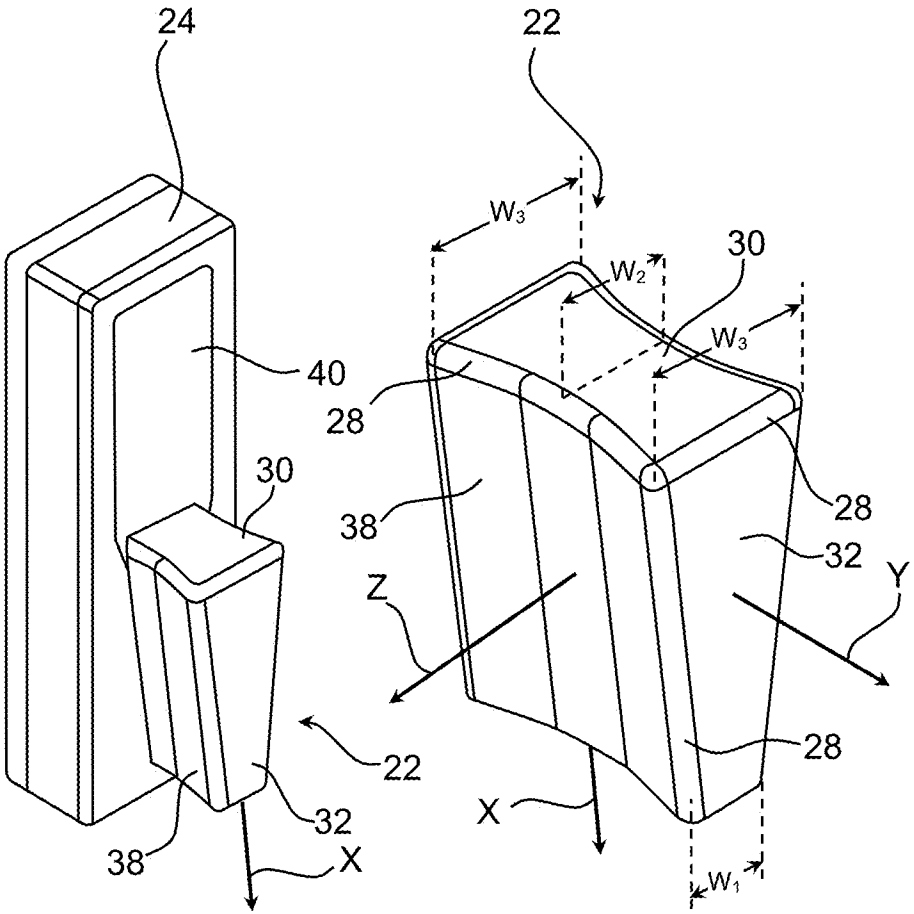
Fig. 2B
Fig. 2A 2
6
6'
12
12'
12''
$M_1$
$M_2$
$M_3$
22
40
42
44
46

Fig. 4A
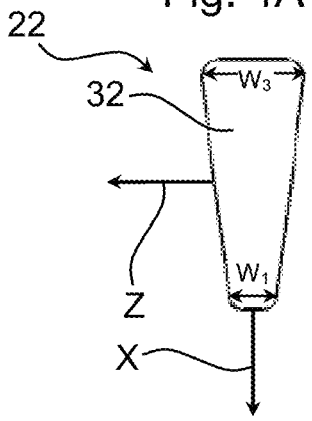
Fig. 4B
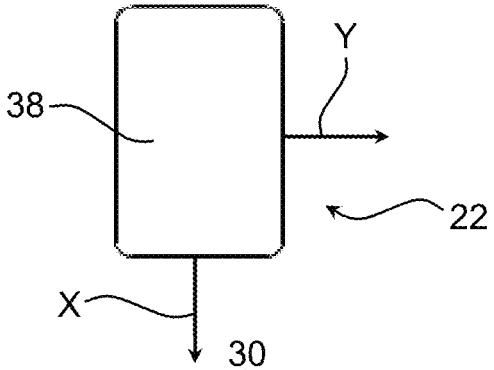
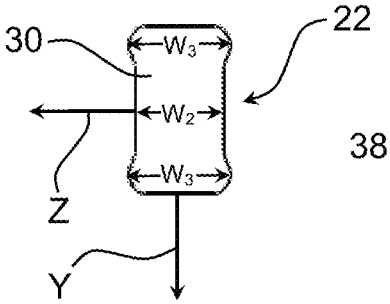
Fig. 4C
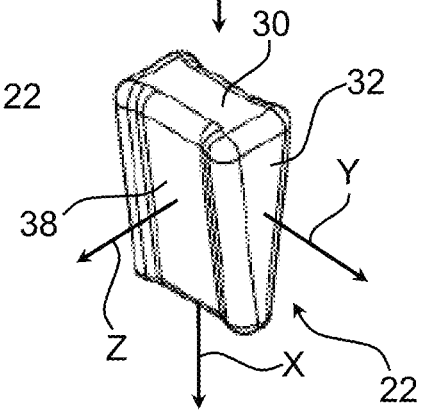
Fig. 4D

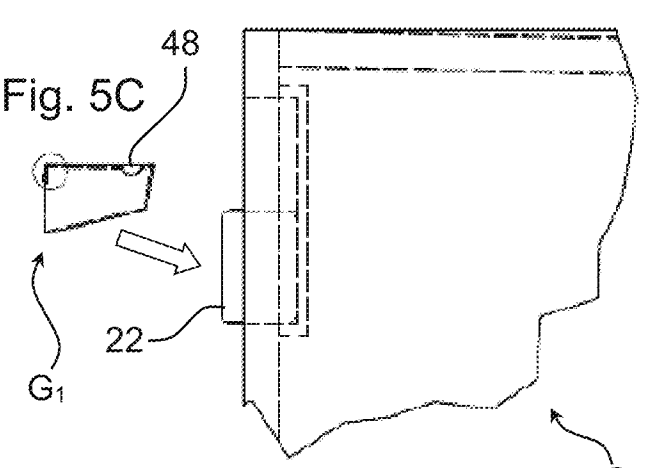
Fig. 5C
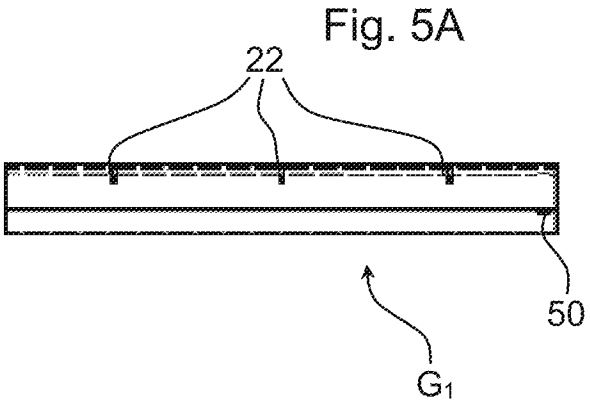
Fig. 5A
Fig. 5B
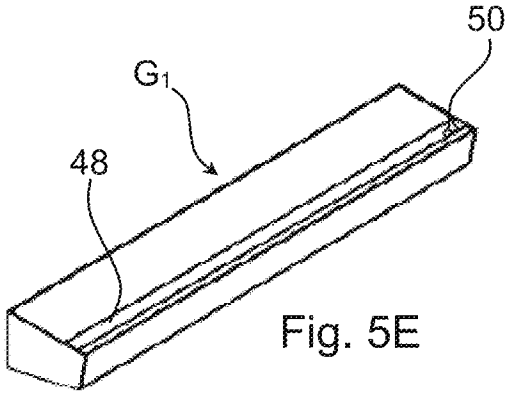
Fig. 5E
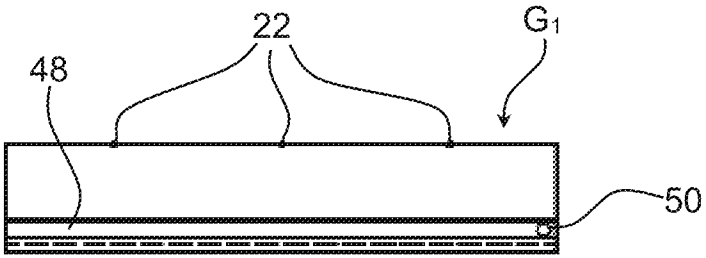
Fig. 5D

BUILDING CONSTRUCTION SYSTEM

CROSS-REFERENCE TO RELATED APPLICATIONS

This application is a continuation of International Application No. PCT/EP2018/068051 filed Jul. 4, 2018, which claims the benefit of priority to Danish Patent Application No. PA 2017 00407, filed Jul. 10, 2017, each of which is incorporated herein by reference in its entirety.

FIELD OF INVENTION

The present invention relates to a building construction system adapted for building constructions. The present invention more particularly relates to a building construction system for construction of buildings that can be assembled and disassembled in a fast and easy manner.

PRIOR ART

It is known to apply expanded foam such as polyurethane (PUR) or polyisocyanurate (PIR) in building constructions. In order to apply a building construction system in building constructions (e.g. interior walls and ceiling panels for domestic buildings), it is required that the building construction system fulfils the fire approval standards (with respect to fire safety). If building construction systems apply fastening means such as metal screws and nails to attach overlapping plate structures covering the expanded foam, the building construction systems will not pass the tests for fulfilling the fire approval standards because, during fire tests, the metal screws and nails transfer heat into the expanded foam and hereby damage the expanded foam.

E.g. from GB 2 399 539, connecting structural sandwich plate members are known. To connect two structural sandwich plate members, each is provided with a channel-shaped connecting member fitted between and projection from the outer metal plates. The two plate members are abutted and welds are formed between the outer plates. The space between opposite plate members may be filled with e.g. polyurethane. Thus, the joints between two adjacent plate members are welded together, thereby inducing the risk that the plate members may fail fire resistance tests according to required standards due to the weldings.

Another modular system suitable for house building is known from EP 2 348 161. The system comprises a plurality of elongate and insulated building elements having an inner and an outer cladding layer in between which a filler material is disposed. The filler material may suitably be polyurethane e.g. in combination with a layer of a fire-retardant material. A number of insert elements connects opposite cladding layers. Adjacent cladding layers are fastened to each other using nails, screws, or staples. Accordingly, the joints between two adjacent cladding layers contains metal parts, thereby inducing the risk that the plate members may fail fire resistance tests according to required standards.

From WO 2016 071747, building elements having two opposite panels of composite type with a core therebetween of a thermally insulating material are known. Connecting elements are inserted between opposite panels. The fixation of adjacent panels may be accomplished using nails, screws or quarter turn systems. The attachment may be supplemented with glue. The glue is, however, only a supplement and optional as gluing admittedly has a number of defects which makes gluing only suitable for filling small defects which might be found in the contact surfaces panel or connecting element. Thus, it is recognised that gluing is insufficient for fastening opposite panels to each other.

From US 2015 0135634, structural insulated panels are known. The panels have a moulded core of expanded polystyrene sandwiched between opposite panels. Adjacent panels are joined using a form of strips, "biscuits", inserted in recesses of adjacent cores. As recognised, it is important that the joints are able to carry shear and tensive stresses, and, thus, the biscuits guard against such problems. The biscuits are moulded into the core. Accordingly, adjacent panels may be fastened to each other without mechanical means, however, the use of biscuits may be expensive and require very accurate manufacturing of the panels. Furthermore, the connecting of the panels may be more complicated and less flexible.

Accordingly, there is need for an improved building construction system that can pass the tests for fulfilling the fire approvals standards and hereby qualify for being used in building constructions. Accordingly, it is an object of the present invention to provide a building construction system that can pass the tests for fulfilling the fire approvals standards.

SUMMARY OF THE INVENTION

The object of the present invention can be achieved by a building construction system as defined in claim 1. Preferred embodiments are defined in the dependent sub claims, explained in the following description and illustrated in the accompanying drawings.

The building construction system according to the invention is a building construction system for construction of a building, wherein the building construction system comprises a plurality of modules each comprising at least one centrally arranged insulation member sandwiched between a first cover plate and a second cover plate, wherein the at least one insulation member is made in PUR or PIR, wherein a reinforcement connection structure extends between and is mechanically connected to opposite cover plates, wherein at least a portion of the joints between adjacent cover plates are glued together.

The building construction system can surprisingly pass the tests for fulfilling the fire approval standards, when at least a portion of the joints are glued together. Accordingly, the building construction system qualifies for being used in building constructions.

The glue to be used in connection with the present invention may suitably adhesives (one or more) having a flash point above 1.000° C., preferably above 1.200° C. Hereby, the adhesive facilitates that the building construction system can pass the tests for fulfilling fire approval standards.

The building construction system can be used for construction of domestic buildings of any suitable size. The building construction system can be used to produce walls, ceilings, gutters and window ledges.

The building construction system comprises a plurality of modules, each comprising at least one centrally arranged insulation member sandwiched between a first cover plate and a second cover plate. The modules may preferably be rectangular (box-shaped) elements configured to be attached together to form walls, sealings ceilings or other plate-shaped structures.

The at least one insulation member is made in PUR or PIR. Hereby, it is possible to achieve a high insulation power and at the same time prevent occurrence of mildew or mould.

The reinforcement connection structure extends between and is mechanically connected to opposite cover plates. Hereby, the reinforcement connection structure provides mechanical strength. Moreover, the reinforcement connection structure and the cover plates define a space, into which PUR or PIR can be filed to achieve a module. reinforcement connection structure may preferably be made in metal, e.g. steel.

At least a portion of the joints between adjacent cover plates are glued together. In some embodiments, the joints in their full extend between adjacent cover plates are glued together.

Hereby, the use of metal fastening means can be eliminated, and the building construction system can pass the tests for fulfilling the fire approval standards.

It may be an advantage that all joints between adjacent structures are glued together. It may further be an advantage that the joints in their full extend between adjacent structures are glued together.

It may be advantageous that a first connector covers at least a portion of the joint between the second cover plates, and/or that a second connector covers at least a portion of the joint between the first cover plates. In some embodiments, the first connector covers at least a portion the joint between the second cover plates, and the second connector covers at least a portion of the joint between the first cover plates. In some embodiments, the first connector covers at least a portion the joint between the second cover plates, or the second connector covers at least a portion of the joint between the first cover plates.

Hereby, the adjacent cover plates will remain closed in case of a fire. The connectors prevent that the joints of adjacent cover plates begin to open.

It may be beneficial that the reinforcement connection structure extends between the first connector and the second connector, wherein the connectors are glued to the cover plates.

Hereby, it is possible to achieve a strong building construction system and to thermally insulate the reinforcement connection structure against the high temperature areas in case of a fire. Accordingly, the reinforcement connection structure will not be heated to such an extent that the heat will damage the insulation member.

It may be advantageous that the reinforcement connection structure is basically C-shaped or I-shaped, wherein the reinforcement connection structure comprises a plane or corrugated central portion.

Hereby, it is possible to provide a strong reinforcement connection structure. By applying a C-shaped or I-shaped reinforcement connection structure having a corrugated central portion, it is possible to increase the mechanical stiffness of the reinforcement connection structure.

It may be an advantage that the reinforcement connection structure is I-shaped, wherein the reinforcement connection structure comprises a plane or corrugated central portion, wherein the reinforcement connection structure is attached directly to the joints of at least two adjacent cover plates, preferably to the joints of both adjacent first cover plates and to the joints of the two adjacent second cover plates.

Hereby, it is possible to provide a simple building construction system. Accordingly, fewer parts are required, and the assembling time can be reduced.

It may be beneficial that the insulation member is covered with cover plates from all sides. Hereby, the building construction system can pass the tests for fulfilling the fire approval standards. Accordingly, the building construction system qualifies for being used in building constructions.

It may be advantageous that all joints between adjacent cover plates and cover plates and connectors are glued with an adhesive having a flash point above 1.000° C., preferably above 1.200° C. Hereby, the adhesive facilitates that the building construction system can pass the tests for fulfilling the fire approval standards.

The adhesive may e.g. be a sodium silicate-based adhesive, such as a sodium metasilicate-based adhesive, a sodium orthosilicate-based adhesive or a sodium pyrosilicate-based adhesive. Specific examples of sodium silicate-based adhesives are generally known in the art.

It may be an advantage that all joints between cover plates and reinforcement connection structures are glued with e.g. a polyurethane-based adhesive. Polyurethane-based adhesives are generally known in the art and includes two-component polyurethane-based adhesives and one-component polyurethane-based adhesives. In general, one-component polyurethane adhesives may be rigid (i.e. curing by heat) or elastic (i.e. curing by moisture). Two-component polyurethane adhesives may be rigid or elastic depending on the structure of thermoset or elastomer.

It may be advantageous that one or more of the module(s) is/are provided with one or more receiving portion(s) provided with one or more recess(es) formed to receive an attachment structure, preferably a wedge.

Hereby, it is possible to provide an easy and reliable, temporary, mechanical attachment of structures that need to be glued together. The temporary, mechanical attachment makes it possible to allow time for the adhesive to cure.

It may be beneficial that the building construction system comprises one or more wedge(s) shaped and configured to be receivingly attached to one or more of the recesses of the receiving portions. Hereby, one or more wedge(s) can be used to attach two wall structures, provided with receiving portions, to each other.

It may be beneficial to construct the building construction system by using a method, in which a first step is to arrange the wedges. In a second step, the end portions are provided with glue. Hereafter, adjacent elements are joint.

The wedges are configured and shaped to position the adjacent elements correctly relative to each other. The wedges are, furthermore, configured to provide a compressive force pressing the adjacent elements sufficiently together. This is important, because a pressure is required when the glue cures. By applying the wedges according to the invention, the elements can be assembled in the location, in which they are intended to be used. Furthermore, no nails or screws are needed to assemble the elements.

The building construction system according to the invention is configured to be moved from one location to another, once the elements of the building construction system are assembled. Hereby, it is possible to arrange a building made by a building construction system according to the invention in various locations and afterwards move the building to another location.

It may be an advantage that the wedge has a basically conical cross-section along its longitudinal axis and is symmetric with respect to the plane spanned by its longitudinal axis and its normal axis, wherein the width at the central portion of the top side of the wedge is smaller than the width at or near the end portions of the top side of the wedge.

Hereby, the wedge can be attached to both a recess in a first module and to a recess in another module, so that the first module and the second module can be mechanically attached to each other by using the wedge.

It may be beneficial that the building construction system comprises one or more gutter(s) provided with one or more wedge(s), and that the building construction system comprises one or more wall(s) provided with one or more receiving portion(s) having one or more recess(es) configured to receive one or more wedge(s).

Hereby, it is possible to attach the gutters to the wall in a simple manner without using attachment structures such as screws and nails.

It may be advantageous that one or more of the modules comprise a top portion provided with one or more opening(s), wherein the building construction system comprises a number of connection members comprising an upper insertion structure, a lower insertion structure and an intermediate structure provided there between, wherein the one or more opening(s) is/are configured to receive the lower insertion structure, whereas the intermediate structure is wide enough to prevent the connection member from being moved further downwards once the intermediate structure is pressed against the top portion.

Hereby, it is possible to maintain a ceiling in a fixed position by using the openings and corresponding connection members while the ceiling is glued to the supporting structure (walls).

The connection members can easily be detachably attached to the openings.

DESCRIPTION OF THE DRAWINGS

The invention will become more fully understood from the detailed description given herein below. The accompanying drawings are given by way of illustration only, and thus, they are not limitative of the present invention. In the accompanying drawings:

FIG. 1A shows a schematic, cross-sectional top view of a portion of a building construction system according to the invention;

FIG. 1B shows a schematic, top view of a portion of a building construction system according to the invention;

FIG. 1C shows a schematic, close-up view of the corner portion of the building construction system shown in FIG. 1B;

FIG. 2A shows a schematic, perspective, top view of a wedge according to the invention arranged adjacent to a construction element;

FIG. 2B shows a schematic, perspective, top view of the wedge shown in FIG. 2A;

FIG. 2C shows another schematic, perspective, top view of the wedge shown in FIG. 2A;

FIG. 4A shows a schematic, front view of a wedge according to the invention;

FIG. 4B shows a schematic, side view of the wedge shown in FIG. 4A;

FIG. 4C shows a schematic, top view of the wedge shown in FIG. 4A;

FIG. 4D shows a schematic, perspective, top view of the wedge shown in FIG. 4A;

FIG. 5A shows a schematic, rear view of a gutter according to the invention;

FIG. 5B shows a close-up view of the gutter shown in FIG. 5C;

FIG. 5C shows a schematic side view of the gutter shown in FIG. 5A;

FIG. 5D shows a schematic top view of the gutter shown in FIG. 5A;

FIG. 5E shows a schematic, perspective top view of the gutter shown in FIG. 5A;

DETAILED DESCRIPTION OF THE INVENTION

Figures 3A, 3B, 3C:
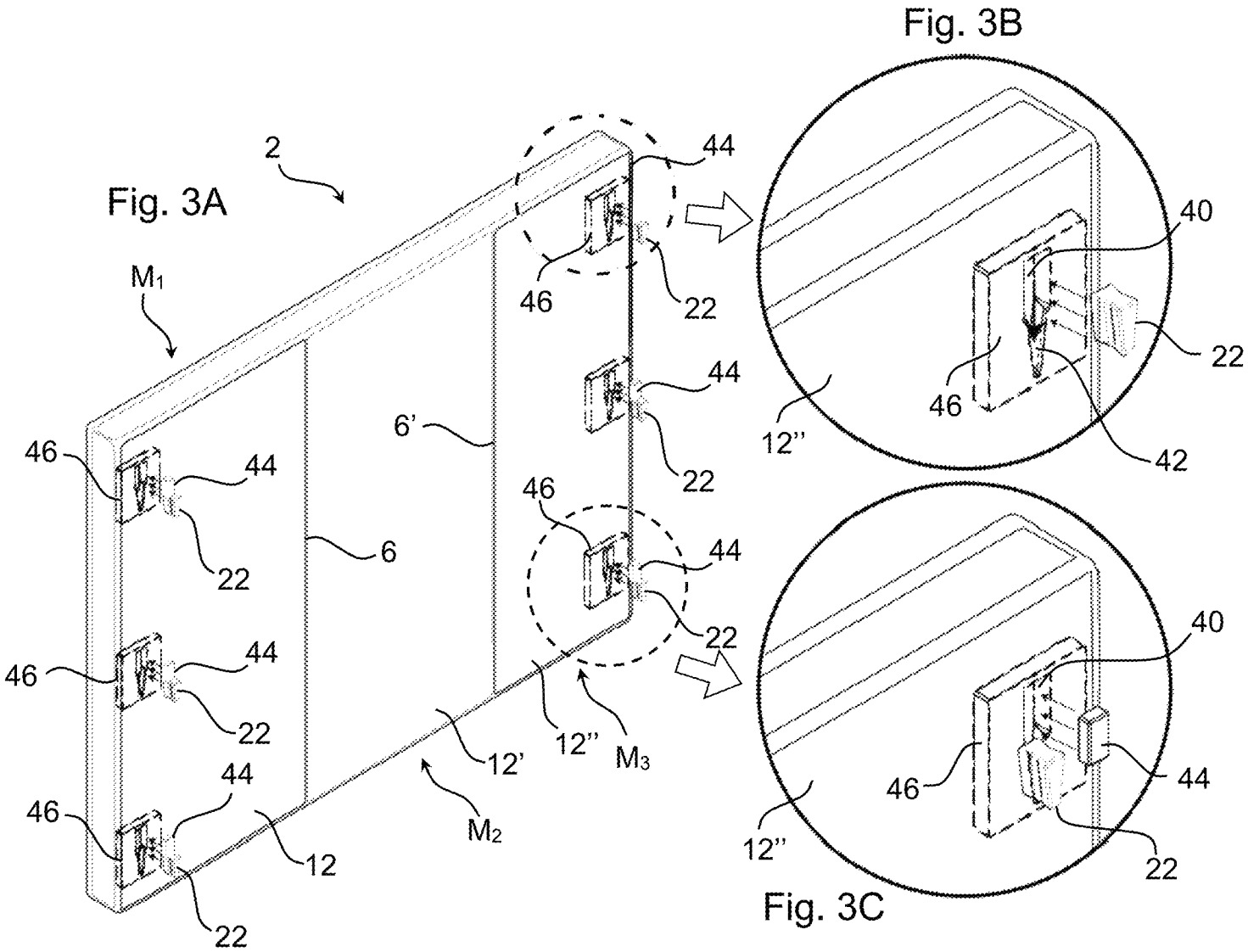
FIG. 3A shows a schematic, perspective, top view of a construction system according to the invention.
FIG. 3B shows a close-up view of the upper right corner portion of the construction system shown in FIG. 3A.
FIG. 3C shows a close-up view of the upper right corner portion of the construction system shown in FIG. 3A, in another configuration.

Referring now in detail to the drawings for the purpose of illustrating preferred embodiments of the present invention, a part of a building construction system 2 of the present invention is illustrated in FIG. 1A.

FIG. 1A is a schematic, cross-sectional top view of a portion of a building construction system 2 according to the invention. The building construction system 2 comprises a first module $M_1$ and a second, abutting module $M_2$. The first module $M_1$ comprises a centrally arranged insulation member 4 sandwiched between a first cover plate 12 and a second cover plate 14.

The second module $M_2$ comprises a centrally arranged insulation member 4' sandwiched between a first cover plate 12' and a second cover plate 14'.

The insulation members 4, 4' are made in PUR or PIR. A reinforcement connection structure 10 (preferably made in a metal, e.g. steel) is provided between the adjacent insulation members 4, 4'. The reinforcement connection structure 10 is C-shaped and comprises a central portion extending between the first cover plates 12, 12' and the second cover plates 14, 14'.

The joints 6, 6' between the adjacent first cover plates 12, 12' and the adjacent second cover plates 14, 14' are glued together. A connector 8 covers the back of the joint between the cover plates 14, 14, and another connector 8' covers the back of the joint between the other cover plates 12, 12. The distal and proximal portions of the reinforcement connection structure 10 abut the connectors 8, 8'. The connector 8 closest to the outside side of the modules $M_1$, $M_2$ is preferably made in a cement-bonded particle board. The connector 8' closest to the inside side of the modules $M_1$, $M_2$ is preferably made in a gypsum fiberboard.

Likewise, the cover plates 14, 14' intended to be arranged closest to the outside side of the modules $M_1$, $M_2$ are preferably made in cement-bonded particle board, whereas the cover plates 12, 12' intended to be arranged closest to the inside side of the modules $M_1$, $M_2$ are preferably made in a gypsum fiberboard. Other suitable plate materials can be used.

In practice, the modules $M_1$, $M_2$ can be made through a manufacturing process in which the cover plates 12, 12', 14, 14', the corresponding connectors 8, 8' and the reinforcement connection structure 10 are glued together. Hereafter, the space between said structures is filled with an expanded foam such as PUR or PIR or a combination thereof.

FIG. 1B illustrates a schematic, top view of a portion of a building 20 made by a building construction system according to the invention. The building 20 comprises a plurality of modules $M_1$, $M_2$, $M_3$, $M_4$ attached to their neighbouring module.

FIG. 1C illustrates a schematic, close-up view of the corner structure 16 of the building shown in FIG. 1B. The corner portion comprises a first module $M_1$ attached to a second module $M_2$ extending perpendicular to the first module $M_1$. The first module $M_1$ comprises a first cover plate 12 and a second, opposing cover plate 14 extending parallel to each other. The first cover plate 12 is arranged at the indoor side and may be made of a gypsum fiberboard. The second cover plate 14 is arranged at the outdoor side and may be made of a cement-bonded particle board. The end portion of the first module $M_1$ comprises a cover plate 14", preferably made in a cement-bonded particle board.

An insulation member 4 made in PUR or PIR is provided in the space defined by the cover plates 12, 14, 14". A C-shaped reinforcement connection structure 10, preferably made in a metal, extends between a first plate-formed connector 8 and a second plate-formed connector 8'. The plate-formed connectors 8, 8' are glued to the adjacent cover plates 12, 14, 14".

The second module $M_2$ comprises a first cover plate 12' and a second, opposing cover plate 14' extending parallel to each other. The first cover plate 12', arranged at the indoor side, may be made of a gypsum fiberboard, whereas the second cover plate 14', arranged at the outdoor side, may be made of a cement-bonded particle board. An insulation member 4' made in PUR or PIR is provided in the space defined by the cover plates 12', 14'. A C-shaped reinforcement connection structure 10 is extending between a first, plate-formed connector 8 and a second, plate-formed connector 8'. The plate-formed connectors 8, 8' are glued to the adjacent cover plates 12', 14'. The contact surface between the first module $M_1$ and the second module $M_2$ is glued. In a preferred embodiment, however, the first module $M_1$ and the second module $M_2$ are provided with matching mechanical attachment structures in order to maintain the first module $M_1$ and the second module $M_2$ positioned during the gluing process.

FIG. 2A illustrates a schematic, perspective, top view of a wedge 22 according to the invention arranged adjacent to a construction element 24. The wedge 22 is arranged next to the construction element 24 provided with a recess 40, through which the wedge 22 can be inserted to attach the wedge 22 to the construction element 24.

The wedge 22 comprises a top portion 30 extending perpendicular to the longitudinal axis X of the wedge 22. The wedge 22 moreover comprises a tapered front portion 32 extending parallel to the longitudinal axis X and being tapered in the direction of the longitudinal axis X. The wedge 22 further comprises side portions 38 having an arced profile.

FIG. 2B illustrates a schematic, perspective, top view of the wedge 22 shown in FIG. 2A. The wedge 22 comprises a top portion 30 having a larger width $W_3$ at the end areas of the top portion 30 than the width $W_2$ at the central area of the top portion 30. The top portion 30 is encased by an arced edge structure 28. The top portion 30 extends perpendicular to the longitudinal axis X of the wedge 22. The wedge 22 has a tapered front portion 32 extending parallel to the longitudinal axis X from an arced edge structure 28 to the opposite narrow end having a width $W_1$ that is smaller than the width $W_2$, $W_3$ indicated on the top portion 30. The front portion 32 extends perpendicular to the lateral axis Y of the wedge 22 and tapers in the direction of the longitudinal axis X. The wedge 22 comprises side portions 38 having an arced profile that basically extends perpendicular to the normal axis Z of the wedge 22.

FIG. 2C illustrates another schematic, perspective, top view of the wedge 22 shown in FIG. 2A. The wedge 22 comprises a bottom portion 34 extending perpendicular to the longitudinal axis X of the wedge. The bottom portion 34 has a larger width at the end areas than at the central area.

The corner regions of the wedge 22 are shaped as arced edge structures 28. The wedge 22 comprises a side portion 36 having an arced profile that basically extends perpendicular to the normal axis Z of the wedge 22. The wedge 22 comprises a tapered, plate-shaped front portion 32 extending perpendicular to the lateral axis Y of the wedge 22. The wedge 22 is configured to attach two elements to each other by arranging the wedge 22 in receiving structures of said elements (see FIG. 3A, FIG. 3B and FIG. 3C).

FIG. 3A illustrates a schematic, perspective, top view of a wall made by a construction system 2 according to the invention. The wall comprises three plate-shaped modules $M_1$, $M_2$, $M_3$ extending in extension of each other. The first module $M_1$ comprises a first cover plate 12. The second module $M_2$ comprises a second cover plate 12', whereas the third module $M_3$ comprises a third cover plate 12".

The first cover plate 12 and the second cover plate 12' are provided with three receiving portions 46 comprising two recesses extending in extension of each other. The receiving portions 46 are configured to receive corresponding wedges 22 and locking blocks 44.

A first joint 6 is provided between the first cover plate 12 and the second cover plate 12', and a second joint 6' is provided between the second cover plate 12' and the third cover plate 12".

FIG. 3B illustrates a close-up view of the upper right corner portion of the wall in FIG. 3A. The third cover plate 12" of the wall is provided with a receiving portion 46. The wedge 22 is formed to be inserted into the upper recess 40 (indicated with the three parallel arrows) and hereafter moved downwards to be receivingly attached to a lower recess 42 as indicated with the large arrow.

FIG. 3C illustrates a close-up view of the upper right corner portion of the wall shown in FIG. 3A and in FIG. 3B in a configuration, in which the wedge 22 has been moved downwards to be receivingly attached to a lower recess 42.

A locking block 44 is being inserted into the upper recess 40 (indicated with the three parallel arrows). When arranged in the upper recess 40, the locking block 44 will prevent the wedge 22 from being displaced upwardly. Accordingly, the wedge 22 is restricted from being removed from the lower recess 42 as long as the locking block 44 is positioned in the upper recess 40.

FIG. 4A illustrates a schematic, front view of a wedge 22 according to the invention. FIG. 4B illustrates a schematic, side view of the wedge 22 shown in FIG. 4A. FIG. 4C illustrates a schematic, top view of the wedge 22 shown in FIG. 4A, whereas FIG. 4D illustrates a schematic, perspective, top view of the wedge 22 shown in FIG. 4A.

The wedge 22 can be used to attach adjacent walls or other elements (e.g. attachment of a gutter to an outside structure of a building). The wedge 22 comprises a front portion 32 shaped as an isosceles trapezium, wherein the corner portions are rounded off. The front portion 32 has its largest width $W_3$ in the first end and the smallest width $W_1$ in the opposite end. The front portion 32 extends along the longitudinal axis X and the normal axis Z of the wedge 22.

The wedge 22 comprises a side portion 38 having an arced profile. The projection of the side portion 38 shown in FIG. 4B is basically rectangular (however with rounded off corners).

The wedge 22 comprises a top portion 30 extending basically along the lateral axis Y and the normal axis Z of the wedge 22. The top portion 30 has its largest width $W_3$ near the end areas and the smallest width $W_1$ in the central portion of the top portion 30.

The wedge 22 is symmetric with respect to the plane spanned by the longitudinal axis and the normal axis Z.

FIG. 5A illustrates a schematic, rear view of a gutter $G_1$ according to the invention. The gutter $G_1$ comprises an outlet 50, from which water can be drained through a rainwater pipe (not shown). The gutter $G_1$ is provided with a plurality of wedges 22, evenly distributed along the back of the gutter $G_1$. The wedges 22 are shaped and configured to be attached to receiving structures arranged on a building structure (e.g. the outside portion of a wall).

FIG. 5C illustrates a schematic side view of the gutter $G_1$ shown in FIG. 5A. The gutter $G_1$ comprises a slit 48 extending along the longitudinal axis of the gutter $G_1$.

FIG. 5B illustrates a close-up view of the gutter $G_1$ shown in FIG. 5C. A wedge 22 is attached to and protrudes from the rear side of the gutter $G_1$. The wedge 22 is configured to be used to attach the gutter $G_1$ to an upright wall of a building.

FIG. 5D illustrates a schematic top view of the gutter $G_1$ shown in FIG. 5A, whereas FIG. 5E illustrates a schematic, perspective top view of the gutter $G_1$ shown in FIG. 5A. Three wedges 22 are attached to and protrudes from the rear side of the gutter $G_1$. A slit 48 extends along the longitudinal axis of the gutter $G_1$, and an outlet 50 is arranged at the end portion of the gutter $G_1$.

Figure 6B:
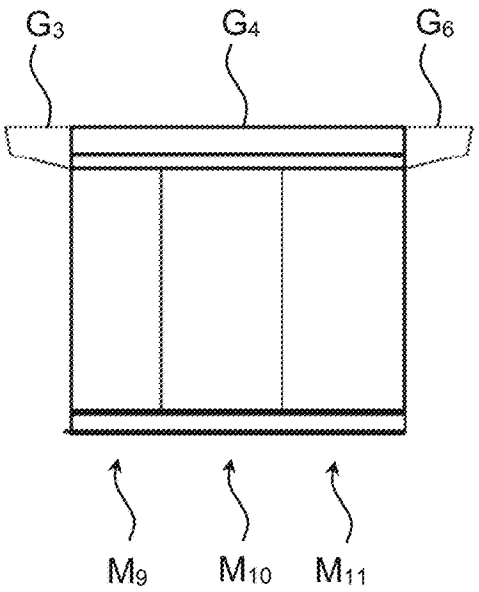
FIG. 6B shows a side view of the building shown in FIG. 6A.
Figure 6A:
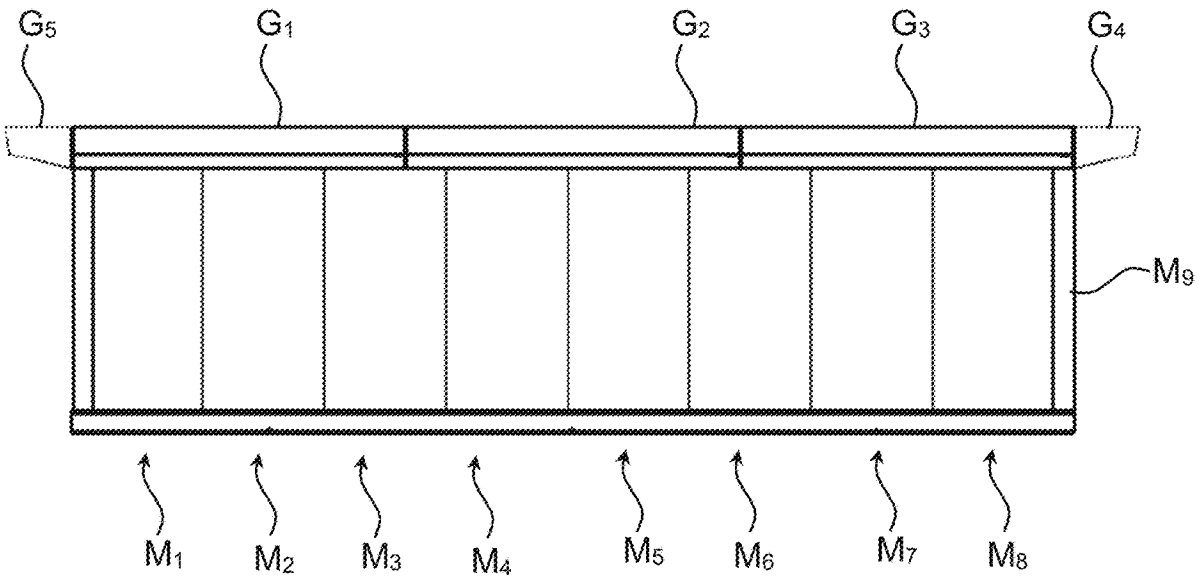
FIG. 6A shows a front view of a building made by a building construction system according to the invention.

FIG. 6A illustrates a front view of the long side of a building made by a building construction system according to the invention, whereas FIG. 6B illustrates a side view of the short side of the building shown in FIG. 6A. The long side of the building comprises a plurality of modules $M_1$, $M_2$, $M_3$, $M_4$, $M_5$, $M_6$, $M_8$, each attached to the adjacent module. Three gutters $G_1$, $G_2$, $G_3$ are attached to the upper portion of the long side of the building. Additional gutters $G_4$, $G_5$ are arranged to the short sides of the building.

The short side of the building comprises three modules $M_9$, $M_{10}$, $M_{11}$, each attached to the adjacent module. A gutter $G_4$ is attached to the upper portion of the short side of the building.

Figures 7A, 7B, 7C:
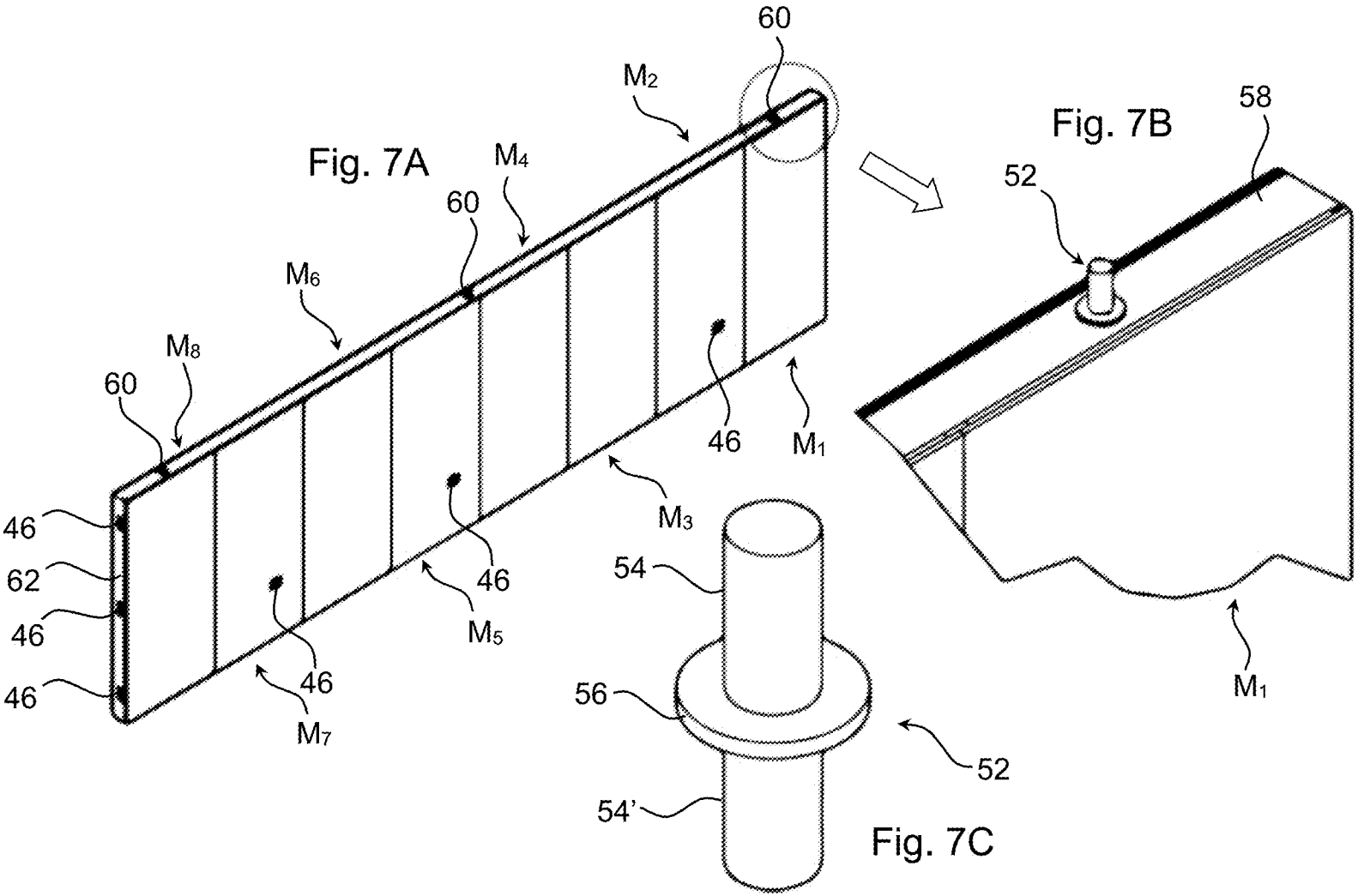
FIG. 7A shows a schematic, perspective top view of a wall made of a building construction system according to the invention.
FIG. 7B shows a close-up view of the top portion of a module of the wall shown in FIG. 7A.
FIG. 7C shows a connection member for positioning the wall shown in FIG. 7A and in FIG. 7B to a roof.

FIG. 7A illustrates a schematic, perspective top view of a wall made of a building construction system according to the invention. The wall comprises eight modules $M_1$, $M_2$, $M_3$, $M_4$, $M_5$, $M_6$, $M_7$, $M_8$ arranged aligned in relation to the same longitudinal axis. An opening 60 is provided in the first module $M_1$, the fifth module $M_5$ and the eighth module $M_5$. The openings 60 are configured to receive a corresponding connection member as shown in FIG. 7B. A roof may be attached to the wall by means of connection members attached to the openings 60.

The second module $M_2$, the fifth module $M_5$ and the seventh module $M_7$ are provided with receiving portions 46 for attachment of wedges as the one shown in FIG. 2B and FIG. 4D. Hereby, it is possible to attach partitions (vertically extending walls) to the modules provided with these receiving portions 46, by means of wedges.

The end portion 62 of the eighth module $M_8$ is provided with three receiving portions 46. Hereby, the eighth module $M_8$ can be attached to a wall to form a corner portion.

FIG. 7B illustrates a close-up view of the top portion 58 of the first module $M_1$ of the wall shown in FIG. 7A. It can be seen that a connection member 52 has been inserted into the opening in the top portion 58 of the first module $M_1$.

FIG. 7C illustrates the connection member 52 shown in FIG. 7B. The connection member 52 comprises an upper, tubular insertion structure 54, a lower, tubular insertion structure 54' and an intermediate structure formed as a flat ring 56 provided there between. The openings 60 shown in FIG. 7A and in FIG. 7B are wide enough to receive the lower insertion structure 54', whereas the intermediate structure 56 is wide enough to prevent the connection member 52 from being moved further downwards once the intermediate structure 56 is pressed against the top portion. Accordingly, the connection members 52 can easily be detachably attached to the openings 60.

Figures 8B, 8D, 8F, 8H:
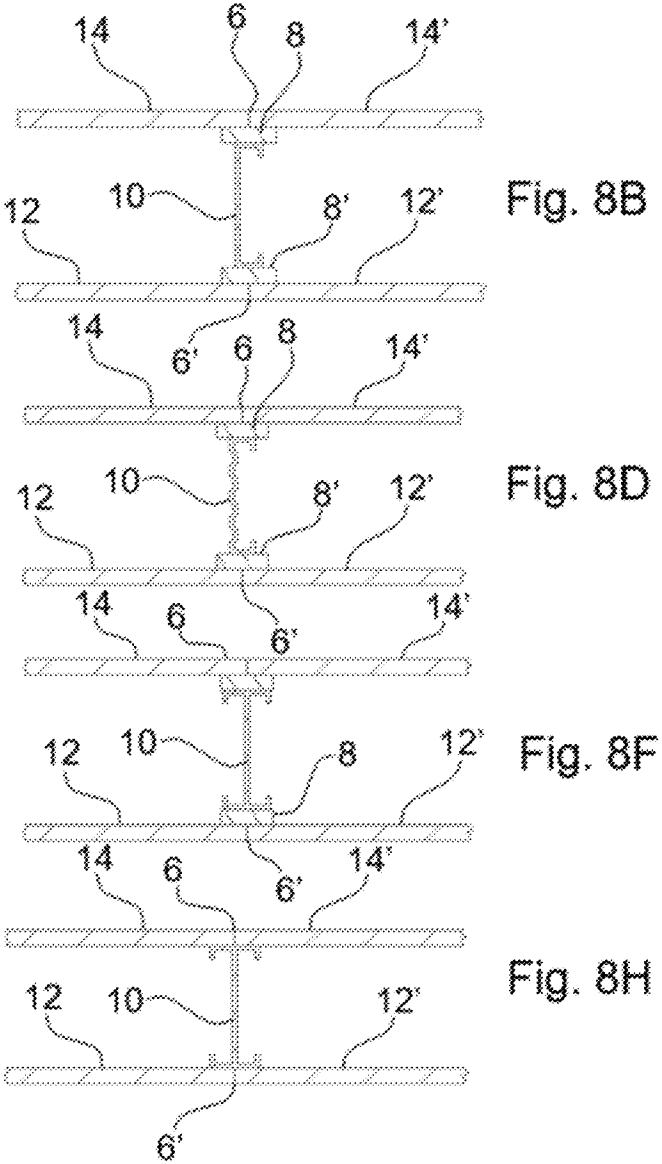
FIG. 8B shows a cross-sectional view of the module shown in FIG. 8A.
FIG. 8D shows a cross-sectional view of the module shown in FIG. 8C.
FIG. 8F shows a cross-sectional view of the module shown in FIG. 8E.
FIG. 8H shows a cross-sectional view of the module shown in FIG. 8G.
Figures 8A, 8C, 8E, 8G:
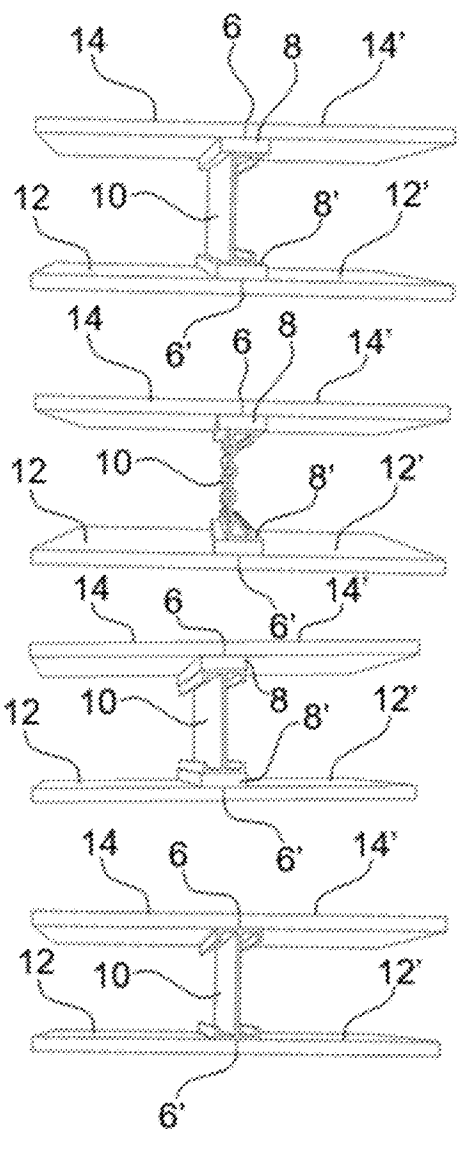
FIG. 8A shows a perspective, top view of a module of a building construction system according to the invention.
FIG. 8C shows a perspective, top view of another module of a building construction system according to the invention.
FIG. 8E shows a perspective, top view of a further module of a building construction system according to the invention.
FIG. 8G shows a perspective, top view of an even further module of a building construction system according to the invention

FIG. 8A illustrates a perspective, top view of a module of a building construction system according to the invention before the insulation member has been provided into the space between the first cover plates 12, 12' and the second cover plates 14, 14'. FIG. 8B illustrates a cross-sectional view of the module shown in FIG. 8A. A C-shaped reinforcement connection structure 10 extends between a first connector 8 (supporting the joint 6 between the second cover plates 14, 14') and a second connector 8' (supporting the joint 6' between the first cover plates 12, 12').

FIG. 8C illustrates a perspective, top view of another module of a building construction system according to the invention before the insulation member has been provided into the space between the first cover plates 12, 12' and the second cover plates 14, 14'. FIG. 8D illustrates a cross-sectional view of the module shown in FIG. 8C. A basically C-shaped reinforcement connection structure 10 extends between a first connector 8 (supporting the joint 6 between the second cover plates 14, 14') and a second connector 8' (supporting the joint 6' between the first cover plates 12, 12'). The reinforcement connection structure 10 comprises a corrugated central portion. Hereby, the mechanical stiffness of the reinforcement connection structure 10 can be increased.

FIG. 8E illustrates a perspective, top view of a further module of a building construction system according to the invention before the insulation member has been provided into the space between the first cover plates 12, 12' and the second cover plates 14, 14'. FIG. 8F illustrates a cross-sectional view of the module shown in FIG. 8E. An I-shaped reinforcement connection structure 10 extends between a first connector 8 (supporting the joint 6 between the second cover plates 14, 14') and a second connector 8' (supporting the joint 6' between the first cover plates 12, 12').

FIG. 8G illustrates a perspective, top view of a further module of a building construction system according to the invention before the insulation member has been provided into the space between the first cover plates 12, 12' and the second cover plates 14, 14'. FIG. 8H illustrates a cross-sectional view of the module shown in FIG. 8G. An I-shaped reinforcement connection structure 10 extends between the joint 6 between the second cover plates 14, 14' and the joint 6' between the first cover plates 12, 12'.

LIST OF REFERENCE NUMERALS

2 Building construction system
4, 4' Insulation member
6, 6' Joint
8, 8' Connector
10 Reinforcement connection structure (e.g. fishplate)
12, 12' Cover plate
14, 14', 14" Cover plate
16 Corner structure
20 Building
22 Wedge
24 Construction element
28 Arced edge structure
30 Top portion
32 Front portion
34 Bottom portion
36 Side portion
38 Side portion
40 Recess
42 Recess
44 Block
46 Receiving portion
48 Slit
50 Outlet
52 Connection member
54 Upper insertion structure
54' Lower insertion structure
56 Intermediate structure
58 Top portion
60 Opening
62 End portion
$M_1$, $M_2$, $M_3$, $M_4$ Module
$M_5$, $M_6$, $M_7$, MB Module
$M_9$, $M_{10}$, $M_{11}$ Module
$W_1$, $W_2$, $W_3$ Width
$G_1$, $G_2$, $G_3$ Gutter
$G_4$, $G_5$, $G_6$ Gutter
X Longitudinal axis
Y Lateral axis
Z Normal axis

The invention claimed is:

1. A building construction system for construction of a building, wherein the building construction system comprises a plurality of modules, each module comprising a first cover plate and a second cover plate, wherein the first cover plates of adjacent modules are glued together to form a first joint and the second cover plates of adjacent modules are glued together to form a second joint between adjacent modules, the building construction system further comprising:

a first connector covering at least a portion of the first joint and glued to the first cover plates of the adjacent modules, a second connector covering at least a portion of the second joint and glued to the second cover plates of the adjacent modules, and a reinforcement connection structure extending between the first connector and the second connector, wherein the construction system comprises end portions extending parallel to the joints, wherein the joints join adjacent modules constituting the building construction, wherein the joints are distanced from said end portions of the construction system;

wherein all joints between adjacent cover plates and between cover plates and connectors are glued with an adhesive having a flash point above 1,000° C. before a space between the first and second cover plates is filled with insulation members comprising polyurethane (PUR) or polyisocyanurate (PIR).

2. A building construction system according to claim 1, wherein the reinforcement connection structure is substantially C-shaped or I-shaped, wherein the reinforcement connection structure comprises a plane or corrugated central portion.

3. A building construction system according to claim 1, wherein the first cover plate, the second cover plate and additional cover plates cover the insulation member from all sides.

4. A building construction system according to claim 1, the adhesive having a flash point above 1.200° C.

5. A building construction system according to claim 1, wherein the building construction system comprises one or more wedges having a basically conical cross-section along its longitudinal axis and is symmetric with respect to a plane spanned by its longitudinal axis and its normal axis, wherein a width at a central portion of a top side of the wedge is smaller than the width at or near the end portions of the top side of the wedge.

6. A building construction system according to claim 5, where the building construction system comprises one or more gutters provided with the one or more wedges, and that the building construction system comprises one or more walls provided with one or more receiving portions having one or more of recesses configured to receive the one or more wedges.

7. A building construction system according to claim 1, where one or more of the modules comprise a top portion provided with one or more openings, wherein the building construction system comprises a number of connection members comprising an upper insertion structure, a lower insertion structure and an intermediate structure provided there between, wherein the one or more openings are configured to receive the lower insertion structure, whereas the intermediate structure is wide enough to prevent the connection member from being moved further downwards once the intermediate structure is pressed against the top portion.

8. A building construction system according to claim 1, wherein one or more of the modules are provided with one or more receiving portions provided with one or more recesses formed to receive an attachment structure.

9. A building construction system according to claim 8, the attachment structure being a wedge.

10. A building construction system according to claim 1, wherein the first joint, the second joint and the portion of the reinforcement connection structure that connects the first connector and the second connector extend along a common line.

11. A building construction system according to claim 1, wherein a width of the first and second connectors is smaller than a distance between the first and second connectors.

* * * * *